United States Patent [19]

Rivera

[11] Patent Number: 5,071,004

[45] Date of Patent: Dec. 10, 1991

[54] TOOL STORAGE APPARATUS

[76] Inventor: Michael A. Rivera, 8755 Tangelo St., Fontana, Calif. 92335

[21] Appl. No.: 622,627

[22] Filed: Dec. 5, 1990

[51] Int. Cl.[5] ..... B65D 85/26; B65D 85/28; B65D 85/00

[52] U.S. Cl. ..... 206/373; 206/376; 206/378; 206/372; 206/375; 206/350; 206/818

[58] Field of Search ..... 206/402, 350, 818, 372, 206/373, 374, 375, 376, 378

[56] References Cited

U.S. PATENT DOCUMENTS

| | | | |
|---|---|---|---|
| 2,580,099 | 12/1951 | Jaeger | 206/818 |
| 3,726,393 | 4/1973 | Thompson | 206/378 |
| 4,340,140 | 7/1982 | Wilcox et al. | 206/373 |
| 4,711,353 | 12/1987 | Rozmestor | 206/378 |
| 4,795,180 | 1/1989 | Polcyn | 206/373 |
| 4,836,374 | 6/1989 | Hutchins et al. | 206/373 |

FOREIGN PATENT DOCUMENTS

| | | | |
|---|---|---|---|
| 858393 | 11/1940 | France | 206/373 |
| 1329755 | 5/1963 | France | 206/375 |
| 221565 | 10/1960 | Netherlands | 206/378 |

*Primary Examiner*—Paul T. Sewell
*Assistant Examiner*—M. D. Patterson
*Attorney, Agent, or Firm*—Leon Gilden

[57] ABSTRACT

An apparatus including a tray with an insert positionable therewithin, the insert includes a plurality of sections, each section including a predetermined matrix of recesses to receive complementarily configured tools therewithin. A plural series of cylindrical recesses are provided, with a positioning rod mounted within and coaxially of each recess to position a socket set within each series of recesses to accommodate a plurality of socket sets. The invention further includes a "T" bar member mounted to the tray, with the "T" bar receiving a magnetically securable lumination member thereon to provide and direct illumination interiorly of the tray to effect visual assistance in tool selection during conditions of limited available light.

2 Claims, 4 Drawing Sheets

PRIOR ART

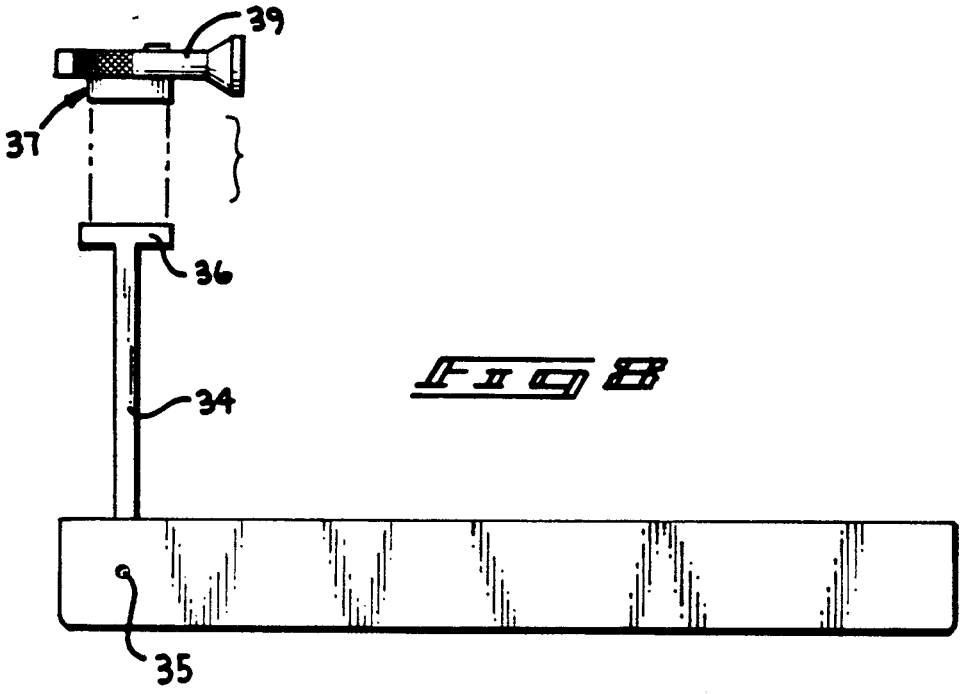
Fig 8
Fig 9
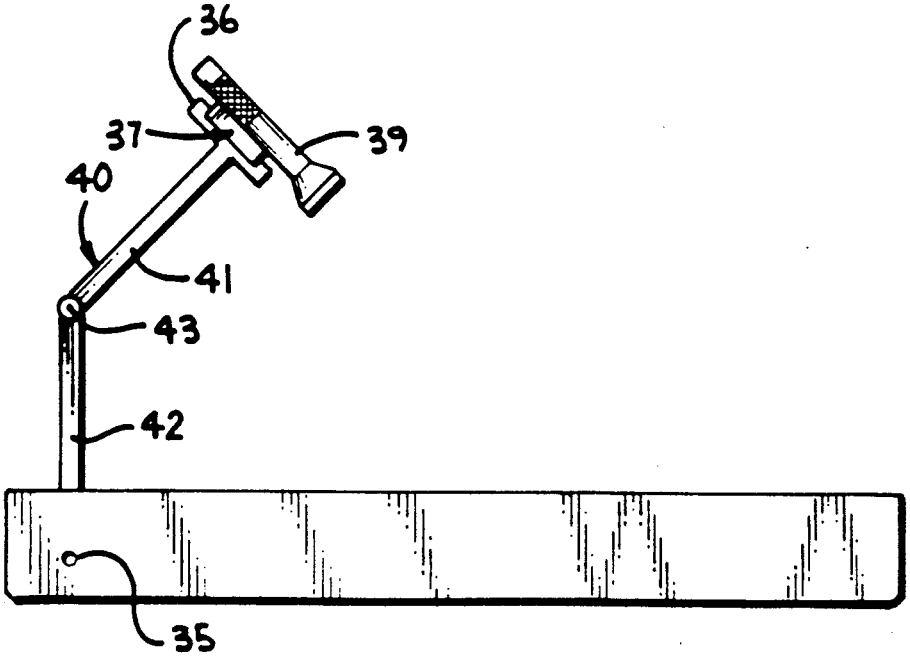

TOOL STORAGE APPARATUS

BACKGROUND OF THE INVENTION

1. Field of the Invention

The field of invention relates to tool apparatus, and more particularly pertains to a new and improved tool storage apparatus wherein the same provides for selective containment of various tools within a tray structure.

2. Description of the Prior Art

Various tool organizing apparatus is available in the prior art to contain and conveniently position tools for access by individuals. Such tool organizing structure may be found for example in U.S. Pat. 4,795,180 to polcyn wherein a tool caddy structure is provided, with separable sections removable relative to one another to provide access to interior compartments of the tool caddy structure.

U.S. Pat. 4,819,800 to Wilson sets forth a tool box with plural sections hingedly mounted together utilizing tubular tool holding portions mounted within the sections for securement of tools therewithin.

U.S. Pat. 4,846,346 to Kime sets forth a tool box structure utilizing a forward and rear section arranged for mounting rearwardly of a pickup type truck.

U.S. Pat. 4,705,168 to Ward sets forth a drawer divider wherein spaced slotted plates are arranged for mounting wrenches in a convenient accessible manner within a tool box drawer structure.

U.S. Pat. 4,836,374 to Hutchins sets forth a tool case including recesses for mounting various tool portions therewithin.

As such, it may be appreciated that there continues to be a need for a new and improved tool storage apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of tool storage apparatus now present in the prior art, the present invention provides a tool storage apparatus wherein the same sets forth an insert mounted within a tool tray with the insert including a series of sections, and each section including variously configured recesses for containing tools therewithin. As such, the general purpose of the present invention, which will be described subsequently in greater detail, is to provide a new and improved tool storage apparatus which has all the advantages of the prior art tool storage apparatus and none of the disadvantages.

To attain this, the present invention provides an apparatus including a tray with an insert positionable therewithin, the insert includes a plurality of sections, each section including a predetermined matrix of recesses to receive complementarily configured tools therewithin. A plural series of cylindrical recesses are provided, with a positioning rod mounted within and coaxially of each recess to position a socket set within each series of recesses to accommodate a plurality of socket sets. The invention further includes a "T" bar member mounted to the tray, with the "T" bar receiving a magnetically securable lumination member thereon to provide and direct illumination interiorly of the tray to effect visual assistance in tool selection during conditions of limited available light.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly form a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved tool storage apparatus which has all the advantages of the prior art tool storage apparatus and none of the disadvantages.

It is another object of the present invention to provide a new and improved tool storage apparatus which may be easily and efficiently manufactured and marketed.

It is a further object of the present invention to provide a new and improved tool storage apparatus which is of a durable and reliable construction.

An even further object of the present invention is to provide a new and improved tool storage apparatus which is susceptible of a low cost of manufacture with regard to both materials and labor, and which accordingly is then susceptible of low prices of sale to the consuming public, thereby making such tool storage apparatus economically available to the buying public.

Still yet another object of the present invention is to provide a new and improved tool storage apparatus which provides in the apparatuses and methods of the prior art some of the advantages thereof, while simultaneously overcoming some of the disadvantages normally associated therewith.

Still another object of the present invention is to provide a new and improved tool storage apparatus wherein the same provides for organized and convenient securement of various tool sets within various sections of a tray insert for convenience of access by individuals.

These together with other objects of the invention, along with the various features of novelty which characterize the invention, are pointed out with particularity in the claims annexed to and forming a part of this disclosure. For a better understanding of the invention, Its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic side view, taken in elevation, of the illumination member mounted to the support bar of the instant invention.

FIG. 9 is an orthographic side view, taken in elevation, of a modified support bar utilized by the instant invention.

DESCRIPTION OF THE PREFERRED EMBODIMENT

Figure 1:
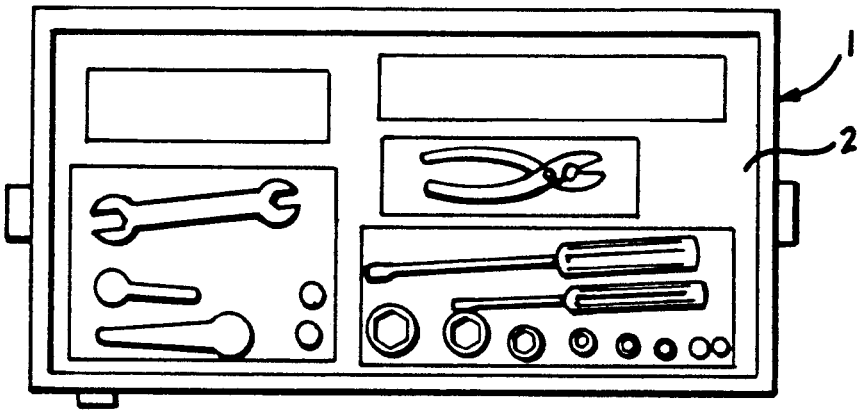
FIG. 1 is a top orthographic view of a prior art tool storage tray structure.

With reference now to the drawings, and in particular to FIG. 1 to 9 thereof, a new and improved tool storage apparatus embodying the principles and concepts of the present invention and generally designated by the reference numeral 10 will be described.

Figure 2:
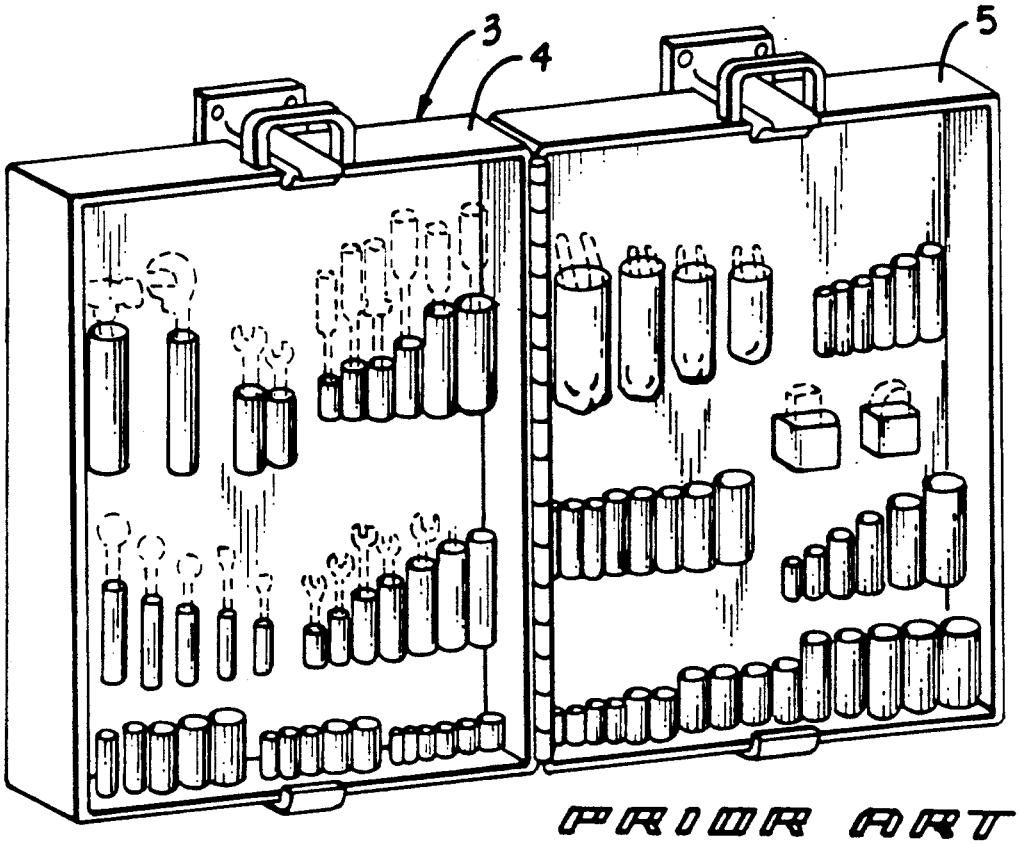
PRIOR ART Fig 2
FIG. 2 is a isometric illustration of a prior art tool storage cabinet.

FIG. 1 illustrates a prior art tool storage tray 1 of a type as typified in U.S. Pat. 4,795,180, wherein a tray member 2 includes variously configured recesses for receiving tool members therewithin. FIG. 2 illustrates a further prior art tool storage structure 3, wherein a first and second tray member 2 are hingedly mounted together, with various receiving cylinders 6 arranged within each tray portion for mounting various tools therewithin, in a manner as set forth in U.S. Pat. 4,819,800.

Figure 3:
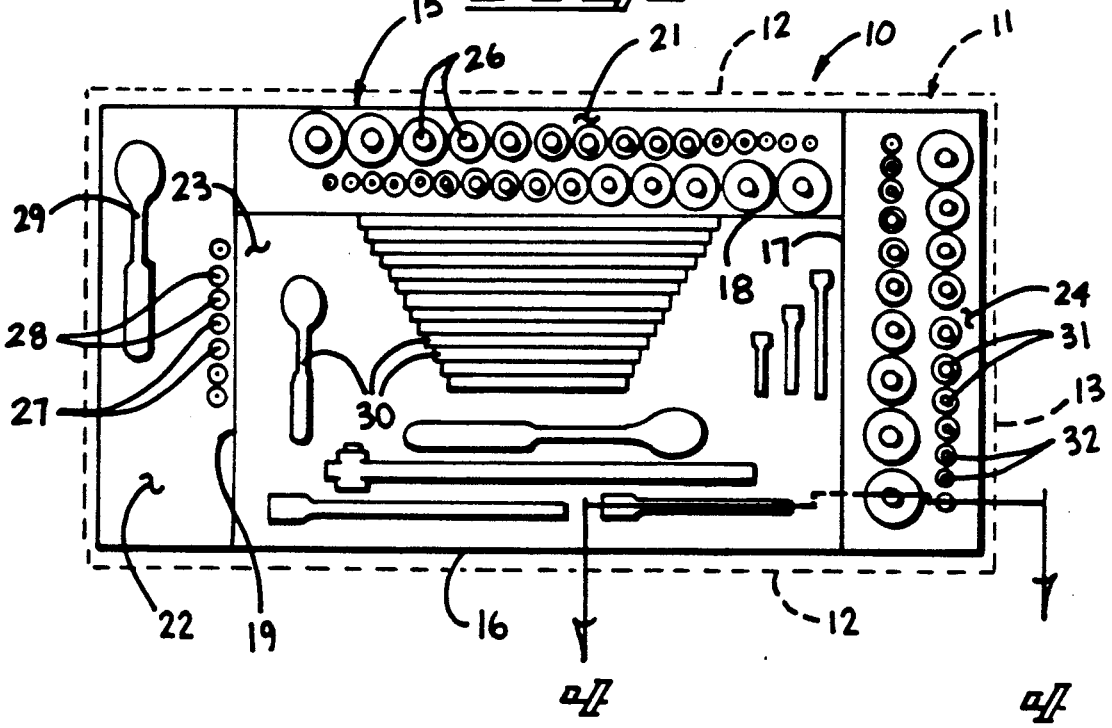
FIG. 3 is a top orthographic view of the instant invention.
Figure 4:
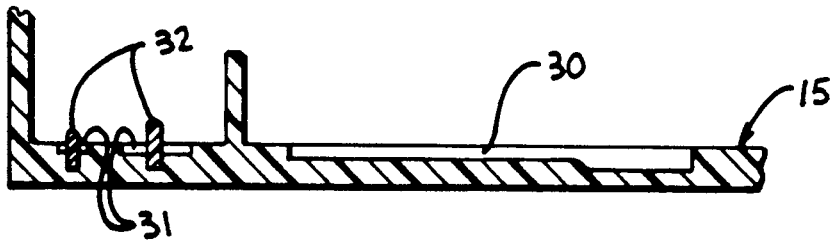
FIG. 4 is an orthographic view, taken along the lines 4—4 of FIG. 3, in the direction indicated by the arrows
Figure 5:
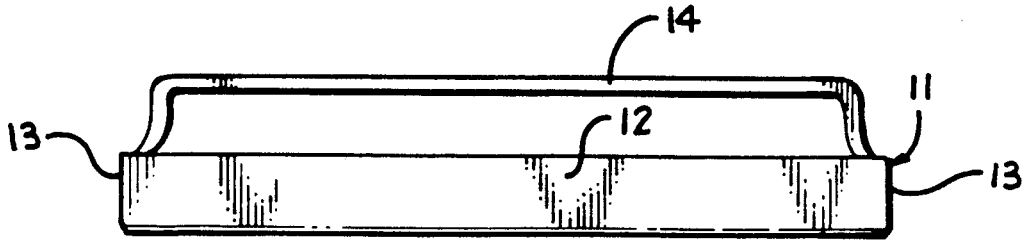
FIG. 5 is an orthographic side view, taken in elevation, of the tool storage tray of the instant invention mounting the insert therewithin.
Figure 6:
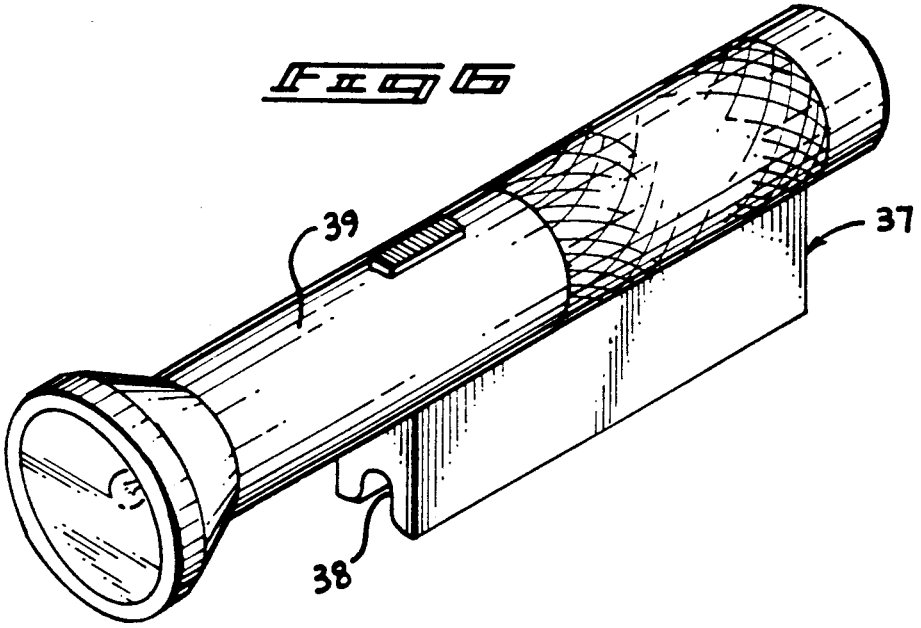
FIG. 6 is an isometric illustration of an illumination member and mounting base utilized by the instant invention.

More specifically, the tool storage apparatus 10 of the instant invention essentially comprises a multi-compartmented support tray 11, including spaced parallel side walls 12 oriented orthogonally relative to spaced parallel end walls 13. A handle 14 is fixedly mounted to the end walls overlying the support tray 11. The invention includes an insert tray 15 that is defined by a surrounding perimeter side wall 16 and a first divider wall 17 directed orthogonally between opposed sides of the perimeter side wall 16, with a second divider wall 18 orthogonally oriented to the first divider wall 17, and a third divider wall 19, with the second divider wall 18 arranged parallel to sides of the perimeter wall 16. A first section 21 is defined between the second divider wall 18 and the perimeter side wall 16, with a second section 22 defined between the third divider wall 19 and an end wall of the perimeter wall 16. A third section 23 is oriented between the first and third divider walls, with a fourth section 24 defined between the first divider wall 17 and the perimeter wall 16, as illustrated in FIG. 3. The first section 21 includes plural rows of first cylindrical cavities 25, with each cylindrical cavity including a first positioning rod 26 coaxially and fixedly mounted within the cylindrical cavity to secure an associated socket therewithin. A series of second cylindrical cavities 27 are arranged within the second section 22, with each second cylindrical cavity including a like series of rods as defined by second positioning rods 28 to secure and position the sockets within the second cylindrical cavities 27. A second section recess 29 receives a complementarily configured tool, such as a ratchet, therewithin for association with sockets positioned within the second cylindrical cavities 27. The third section 23 includes third section elongate recesses 30 arranged in a parallel relationship adjacent the second divider wall 18 for securing wrench-like members therewithin, as well as tools such as ratchets, extensions, and the like, as illustrated. The fourth section 24 includes fourth section third cylindrical cavities 31, each including fourth section third positioning rods 32 to maintain and align a socket within each of the cavities. As illustrated, the support tray 11 removably receives the insert tray 15 therewithin for convenience of positioning of the various tools.

Figure 7:
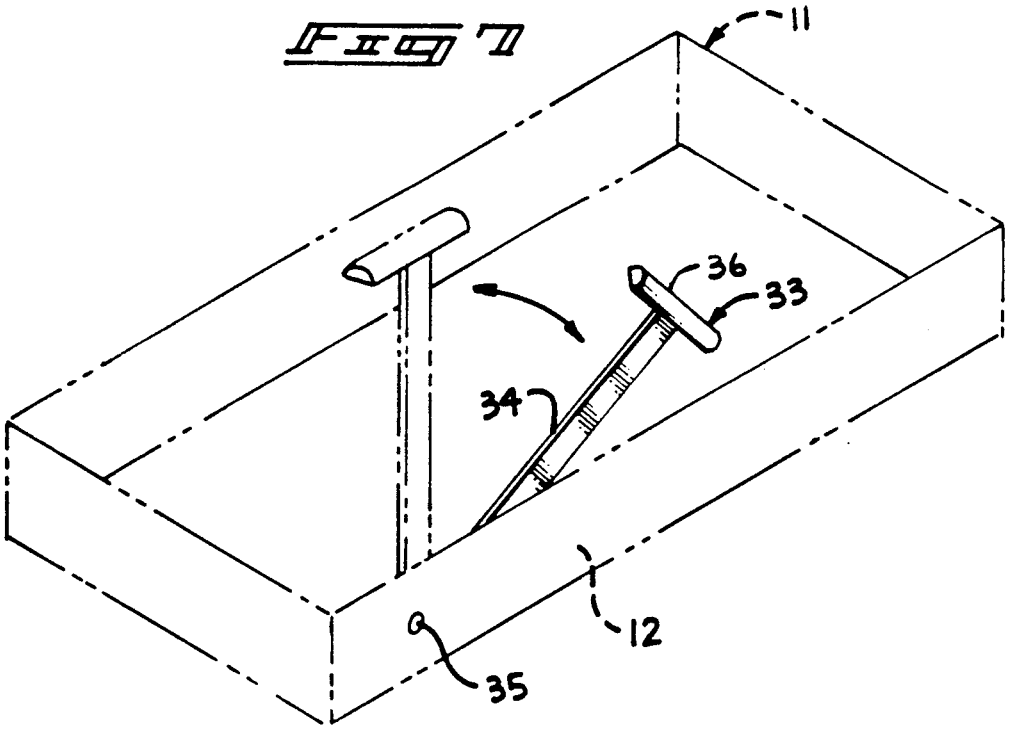
FIG. 7 is an isometric illustration of the support bar receiving the mounting base, as illustrated in FIG. 6.

Reference to FIG. 7 illustrates the support tray 11, including a "T" bar member 33 pivotally mounted to a side wall 12. The "T" bar member includes a first pivot axle 35 at a lower terminal end of a first pivoting bar 34, with the first pivoting bar 34 pivotally oriented and mounted relative to the side wall 12. A cylindrical mounting bar 36 formed of a ferrus metallic material is orthogonally and fixedly mounted to an upper terminal end of the first pivoting bar 34. A magnetic mounting block 37 includes a cylindrical groove 38 coextensively through a bottom wall of the block 37 complementarily receiving the cylindrical mounting bar 36 therewithin in a removable manner, with a flashlight 39 fixedly mounted to a top surface of the mounting block 37 spaced from the groove 38. In this manner, the "T" bar 33 may be pivoted in a generally vertical orientation for illumination of contents of the support tray 11.

FIG. 9 illustrates the use of a modified first pivoting bar 40 that includes a top bar portion 41 and a bottom bar portion 42, with a second pivot axle 43 pivotally mounting the top and bottom bar portions 41 and 42 together, wherein the second pivot axle 43 is defined by a friction connection to orient the top and bottom bar portions in a desired orientation to angularly orient the flashlight member 39 downwardly in the tray structure, as illustrated. As illustrated, the mounting block 37 is mounted to the mounting bar 36 that is fixedly secured to an upper terminal end of the top bar portion 41.

As to the manner of usage and operation of the instant invention, the same should be apparent from the above disclosure, and accordingly no further discussion relative to the manner of usage and operation shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool storage apparatus comprising, in combination, a support tray, the support tray including spaced parallel side walls and parallel end walls, the support tray including an insert tray removably mounted within the support tray, the insert tray including a plurality of divider walls, the divider walls defining plurality of sections, each section including a plurality of cavities, each cavity arranged for complementarily receiving a tool member therewithin, and wherein the insert tray includes a perimeter side wall extending continuously about the insert tray, and the plurality of divider walls includes a first divider wall intersecting the first divider wall, and a third divider wall, and a second divider wall intersected orthogonally by the second divider wall, and the plurality of sections includes a first section arranged between the second divider wall and the perimeter wall, a second section positioned between the third divider wall and the perimeter wall, a third section adjacent the first section positioned within the second divider wall, the third divider wall and the perimeter wall, and a fourth section arranged between the first divider wall and the perimeter wall, and wherein the plurality of cavities includes a plurality of first cylindrical cavities arranged within the first section, a plurality of second cylindrical cavities arranged within the second section, and a plurality of third cylindrical cavities arranged within the third section, each of the cylindrical cavities including a positioning rod coaxially and fixedly mounted within each of the cylindrical cavities for securing a socket tool within each of the cylindrical cavities, and wherein at least one of said side walls of the support tray includes a "T" bar mounted thereto, the "T" bar including a first pivoting bar, a lower terminal end of the first pivoting bar including a first pivot axle securing the lower terminal end of the first pivoting bar to the at least one side wall, and a mounting bar fixedly and orthogonally mounted to an upper terminal end of the first pivoting bar, the mounting bar formed of a ferrous metallic material, and a magnetic mounting block, including a cylindrical groove coextensively directed through a bottom surface of the mounting block, the cylindrical groove complementarily mounting the mounting bar, and the mounting block including a flashlight member mounted thereon.

2. An apparatus a set forth in claim 1 wherein the first pivoting bar includes a top bar portion and a bottom bar portion, the top bar portion and the bottom bar portion including a second pivot axle securing a top bar portion to the bottom bar portion, wherein the second pivot axle is defined by a frictional interconnection to permit angular orientation of the top bar portion to the bottom bar portion.

* * * * *